US007074994B2

(12) United States Patent
Belli

(10) Patent No.: US 7,074,994 B2
(45) Date of Patent: Jul. 11, 2006

(54) TUNABLE DRUMHEAD

(75) Inventor: Remo D. Belli, Sherman Oaks, CA (US)

(73) Assignee: Remo, Inc., Valencia, CA (US)

( * ) Notice: Subject to any disclaimer, the term of this patent is extended or adjusted under 35 U.S.C. 154(b) by 0 days.

(21) Appl. No.: 10/627,301

(22) Filed: Jul. 28, 2003

(65) Prior Publication Data

US 2005/0022648 A1 Feb. 3, 2005

(51) Int. Cl.
*G10D 13/02* (2006.01)

(52) U.S. Cl. ..... 84/411 R

(58) Field of Classification Search ..... 84/411 R, 84/414, 413, 411 A, 411 P, 416; D17/22, D17/99; 446/318
See application file for complete search history.

(56) References Cited

U.S. PATENT DOCUMENTS 3,405,586 A * 10/1968 Koishikawa ..... 84/414
4,077,297 A * 3/1978 Woodson ..... 84/411 R
4,775,574 A * 10/1988 Fukushima et al. ..... 428/209
D320,035 S * 9/1991 Magruder ..... D17/22
5,610,350 A * 3/1997 Miller ..... 84/413
6,063,992 A * 5/2000 Schwagerl ..... 84/411 P
6,365,812 B1 * 4/2002 McGill ..... 84/414
6,586,665 B1 * 7/2003 Liao et al. ..... 84/411 R

* cited by examiner

*Primary Examiner*—Kimberly Lockett
(74) *Attorney, Agent, or Firm*—Rapkin, Gitlin & Beaumont

(57) ABSTRACT

An improved drumhead comprising a substantially annular hoop having a generally planar upper member spaced apart from a generally planar lower member, a circumferential inner rim and a circumferential outer rim. Also provided is a film material or membrane for constituting a drumming surface, which extends flat across the area defined within the circumferential inner rim and the circumferential outer rim. Integrally formed with the film material or membrane of the drumming surface is an annular shoulder, which extends at its base between the planar upper and lower members in a co-planar orientation with the annular hoop. The drumhead is adaptable for use with a large variety of percussion instruments including toms, snare drums, bass drums, tambourines, congas, bongos and many other types of ethnic and other drums.

16 Claims, 7 Drawing Sheets

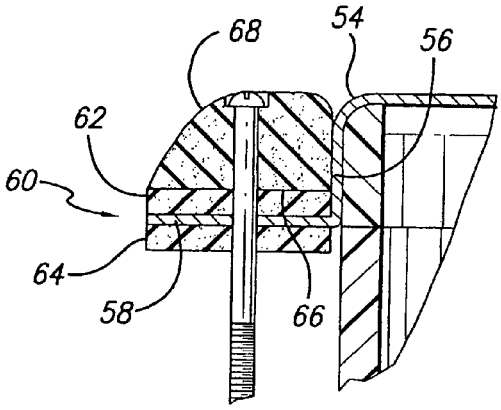
FIG. 4A
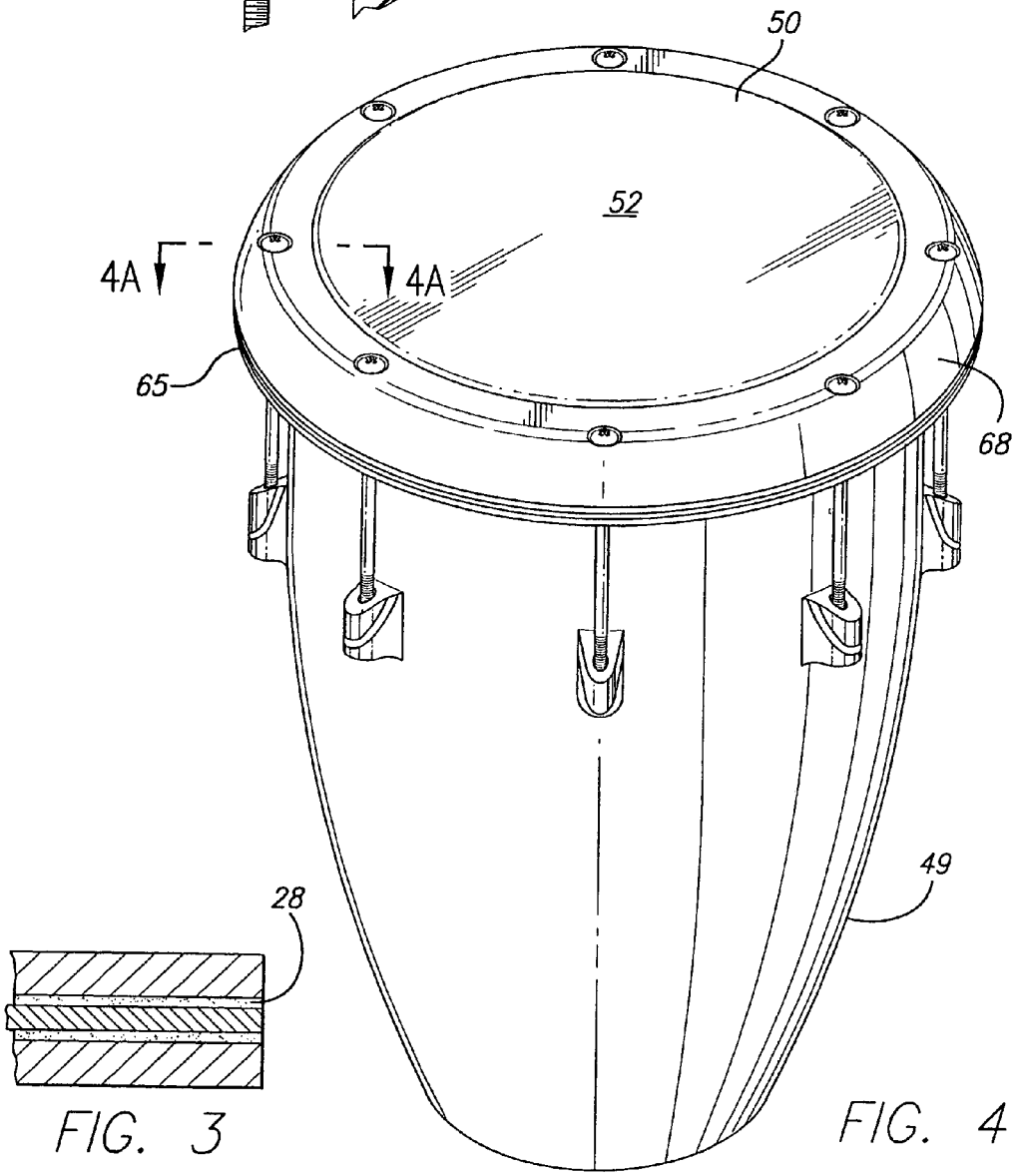
FIG. 3
FIG. 4

TUNABLE DRUMHEAD

BACKGROUND OF THE INVENTION

1. Field of the Invention

The present invention relates to musical drums and, more particularly, to an improved percussion device that can be employed as a versatile drumhead in combination with conventional and other types of drumshells.

2. Description of the Prior Art

Conventional drums typically comprise a cylindrical shell fashioned from wood, metal or a synthetic material, or a combination of these. A separate drumhead is attached and covers one or both ends of the shell to act as the contact surface for producing the desired drum sounds.

Drumshells are constructed so that the shell wall, which is normally annular, is orientated perpendicularly to the plane of the drumhead. A conventional drumhead is formed and bent at its periphery to enable tension to be applied at right angles, i.e. by employing a plurality of devices such as drum lugs, connected to the shell to pull at the periphery of the head (in a direction normal to the head surface) to stretch and tension the film. The direction of the tensioning effort is coincident with the head's vertical axis, more specifically coincident with the generally vertical plane of the bent or angular portion of the section of the head disposed around its periphery.

In general, conventional heads comprise a vibratile sheet or membrane, which is stretched over an annular hoop, usually metal, having an inner and an outer rim that define a channel. Typically, the channel is filled with some type of adhesive or resin into which the bent peripheral portion or edge of the membrane is inserted. The adhesive or resin is then permitted to cure, enabling the film (or membrane) a fixed and secure connection to the hoop. Often, a curved metal bar is inserted into the channel on top of the portion of the drumhead membrane submerged beneath the resin, until the resin cures. This gives added strength to the connection between the hoop and the membrane.

The drumhead is then placed over one end (or both ends) of a drumshell. A standard rim mounted counterhoop is placed over and in tight contact with the annular hoop to secure the drumhead to the shell. Thereafter, the counterhoop is employed in combination with any suitable tensioning mechanism to tension or tune the drumhead, as necessary.

Though the connection between the hoop and the membrane can be a relatively strong one, certain drawbacks remain. In time, even this kind of connection loses strength and the bonded relationship between the hoop, resin and membrane begins to deteriorate. One reason for this can be traced to certain physical factors, including the limited bond strength existing between a small amount of resin attempting to secure and maintain a strong bond with a relatively small piece of membrane submerged within. Thus, the surface area of the membrane in contact with the resin is minimal, and eventually the bond breaks.

Another drawback associated with the drumheads of the prior art is their inability to join with certain types of drumshells because of their incompatibility of design and structure. For example, a conventional drumhead cannot easily join with a conga or bongo type drumshell, even with the use of a counterhoop. What occurs in this situation is the difficulty the drummer has in striking the drumhead with his or her hand while somehow keeping the hand from striking the (usually metal) drum lug components in the process. The constant contact between the hands and the hard, unforgiving metal lugs eventually causes the hands to become tender and ultimately suffer severe pain from exposure to the repeated trauma.

Thus, it is desirable to provide a versatile drumhead construction for use in combination with all types of tunable drums, including, without limitation, toms, snares, bass drums, congas, bongos and other ethnic drums.

The drum head of the present invention employs a construction in which the striking or contact surface of the head, i.e. the film or membrane, is situated above an integrally formed annular shoulder or vertical wall, which continues at its base in a co-planar orientation with a separate hoop component, which bonds securely to the top and bottom surfaces of the film along the base. This improved instrument enables the tunable or tensioned film, which combines with a flat hoop, to vibrate significantly more freely than the film is capable of when simply joined with a standard rim mounted counterhoop in combination with a conventional hoop. The improved drumhead in combination with any kind of drumshell produces sounds with a great deal more quality and integrity of tone than before.

The present invention has other applications. Employing proper support means attached to the inside of the shell wall, the drumhead can be supported and fixed in place at the shell opening, near or substantially even with the shell's circumventing edge. The improved drumhead can also be adapted over the rim portion of a conventional shell and then mounted there using conventional tensioning mechanisms. When used with a conga drum, a counterhoop with a separate annular piece having a rounded or curved top or exterior surface can be placed over the annular hoop fully enclosing and surrounding the annular shoulder. Thus, this annular piece with its upper exterior or surface coincidental with the plane of the membrane acts both as a counterhoop and as a guard and support member for the hands to preclude against soreness or serious injury.

SUMMARY OF THE INVENTION

In its preferred embodiment, the present invention provides an improved drumhead comprising a substantially annular hoop having a generally planar upper member spaced apart from a generally planar lower member, a circumferential inner rim and a circumferential outer rim. Also provided is a film material or membrane for constituting a drumming surface, which extends flat across the area defined within the circumferential inner rim and the circumferential outer rim. Integrally formed with the film material or membrane of the drumming surface is an annular shoulder, which extends at its base between the planar upper and lower members in a co-planar orientation with the annular hoop.

The drumhead is adaptable for use with a large variety of percussion instruments including toms, snare drums, bass drums, tambourines, congas, bongos and many other types of ethnic and other drums.

The drumhead can be pre-tuned, but is preferably tunable. Tunable embodiments of the invention require a tensioning mechanism, which may include any suitable bolt or rod that can be inserted into the plurality of spaced openings fashioned within the body of the annular hoop. A lug nut or a similar type of device joining with the tensioning bolt or rod, when rotated, will create a force normal to the plane of the hoop to cause a tightening of the drumhead to enable the tuning of the device. The tensioning mechanisms can be mounted either on the inside or outside of the shell in any suitable location to achieve the intended objective. A counterhoop with a flat or rounded surface may also be employed to achieve a proper tensioning of the head as well as to contribute aesthetically to the appearance of the present invention. A counterhoop with a rounded or arched upper surface also acts as a guard or support member for the hands to prevent soreness or injury.

Construction of the invention can involve the use of a plurality of layers of film and high density fiberboard, which acts as the co-planar hoop in the shell component. Suitable adhesive is applied to bond the layers. Mechanical means can be used to add strength to the adhesive bond.

Although annular is the preferred shape of the hoop and the film material, other configurations can be employed, including oval, rectangular, square, triangular and a variety of other geometric shapes.

Accordingly, it is an object of the present invention to provide an improved percussion instrument that employs a flat hoop.

It is also an object of the present invention to provide an improved percussion instrument that combines a film, which includes an annular shoulder formed below the rim of the striking surface, with a flat hoop.

It is yet another object of the present invention to provide an improved percussion instrument wherein the surface to surface contact between the peripheral areas of the film, which extend horizontally at the base of the shoulder, and the flat hoop is maximized.

It is yet another object of the present invention to provide an improved percussion instrument that enables the film component of the drumhead to vibrate more freely than the same film is capable of doing when joined with a conventional cylindrical hoop.

It is still another object of the present invention to provide an improved percussion instrument that can accommodate a counterhoop that acts also as a guard or support member for the hands to preclude against soreness or injury.

It is yet still another object of the present invention to provide an improved percussion instrument that produces sounds with more quality and integrity of tone than was possible with the prior art percussion instruments.

Yet still another object of the present invention is to provide an improved percussion instrument that is adaptable for use as a drumhead with a wide variety of drums, including toms, snares, bass drums, congas, bongos and others.

Yet still another object of the present invention is to provide an improved percussion instrument that is adaptable for use with a generally flat or rounded surface counterhoop to enable the head to join with a conventional drumshell, and be appropriately tensioned and tuned.

Yet still another object of the present invention is to provide an improved percussion instrument that employs a pre-tuned or tunable convertible drumhead.

Yet still another object of the present invention is to provide an improved percussion instrument that is easy and cost effective to manufacture.

Other objects and advantages of the present invention will become apparent in the following specifications when considered in light of the attached drawings wherein a preferred embodiment of the invention is illustrated.

BRIEF DESCRIPTION OF THE DRAWINGS

FIG. 3 is a fragmented cross-sectional view of the improved drumhead of the present invention.

FIG. 4 is a perspective view of the improved drumhead of the present invention shown in combination with a conga shell.

FIG. 4A is a cross-sectional view of the present invention taken along line 4—4 of FIG. 4.

DETAILED DESCRIPTION OF THE PREFERRED EMBODIMENT

Figure 1:
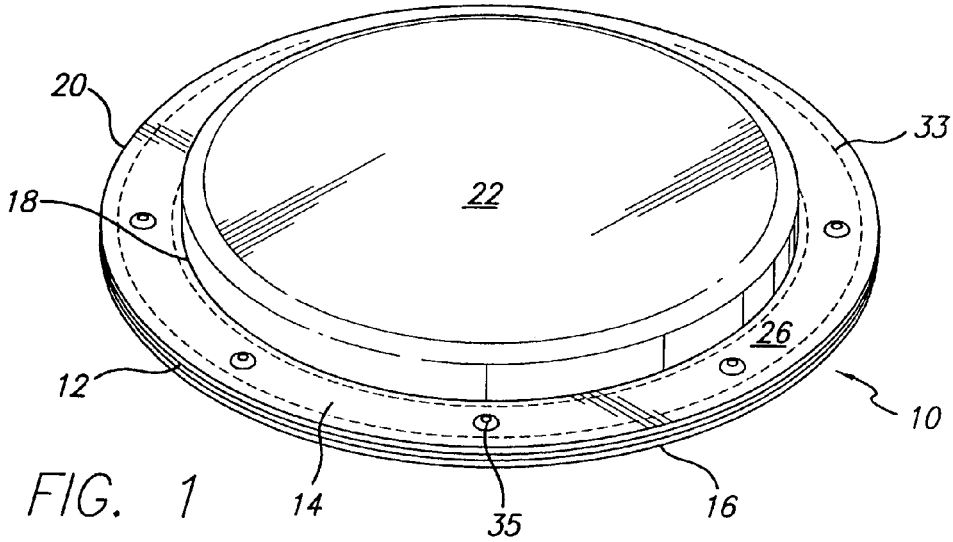
FIG. 1 is a perspective view of the improved drumhead of the present invention.
Figure 2:
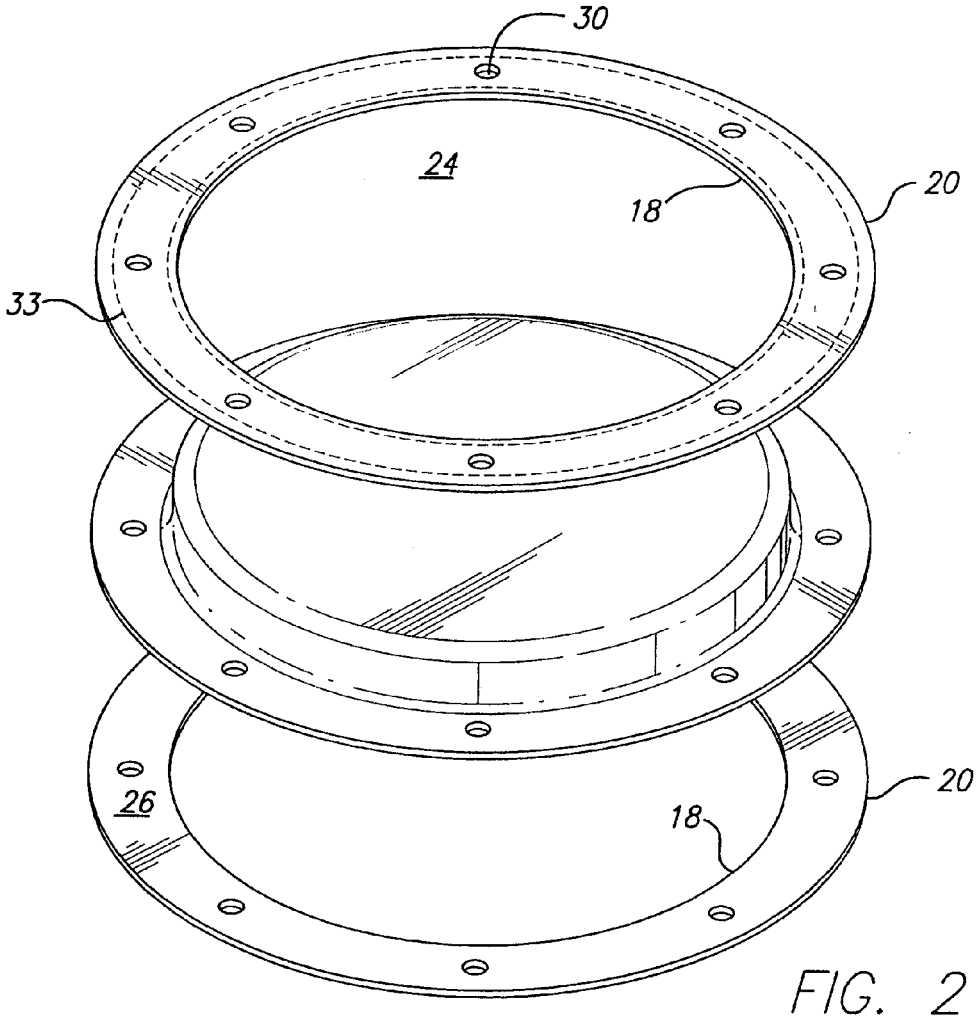
FIG. 2 is an exploded view of the improved drumhead of the present invention depicting its individual components.
Figure 5:
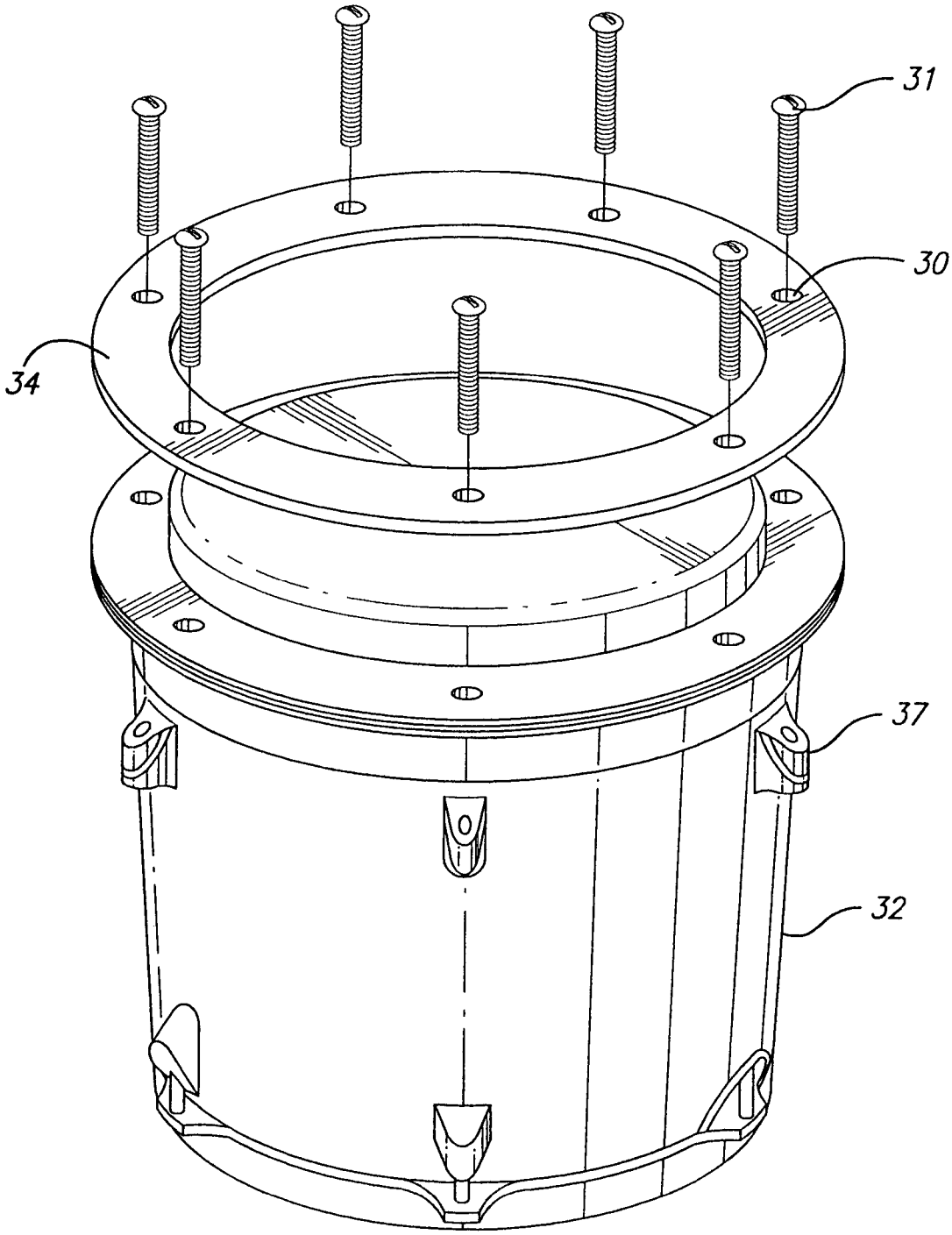
FIG. 5 is a perspective view of the improved drumhead of the present invention shown (with a flat counterhoop) about to be installed and tensioned on a conventional drumshell.
Figure 6:
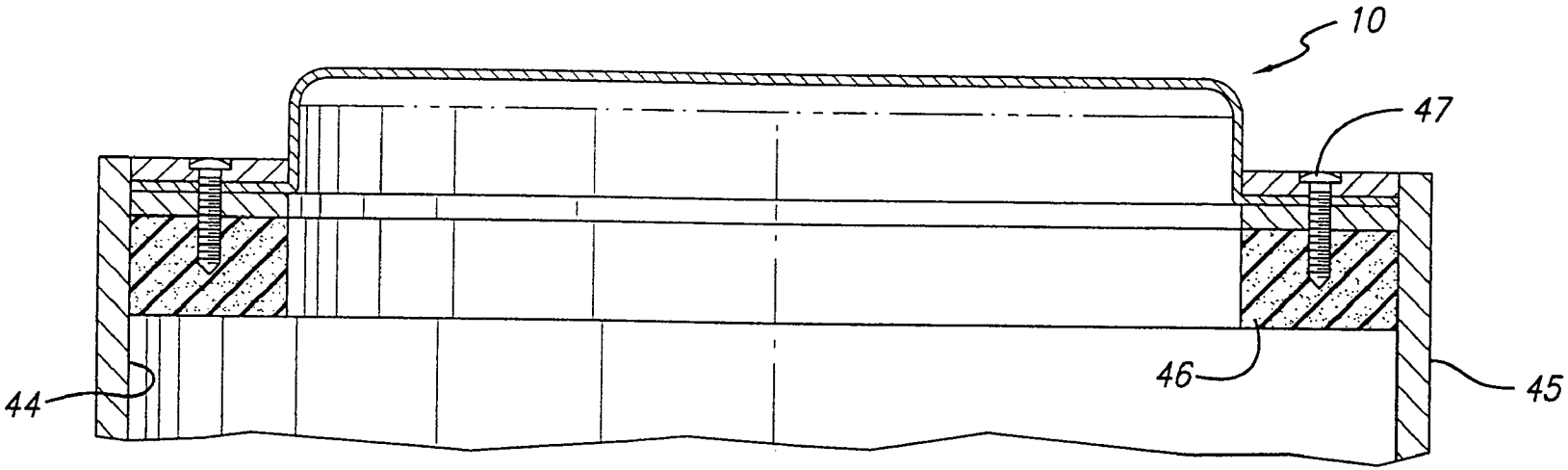
FIG. 6 is a perspective view of the improved drumhead of the present invention shown using an alternative means to install and tension the head on a conventional drumshell.
Figure 7:
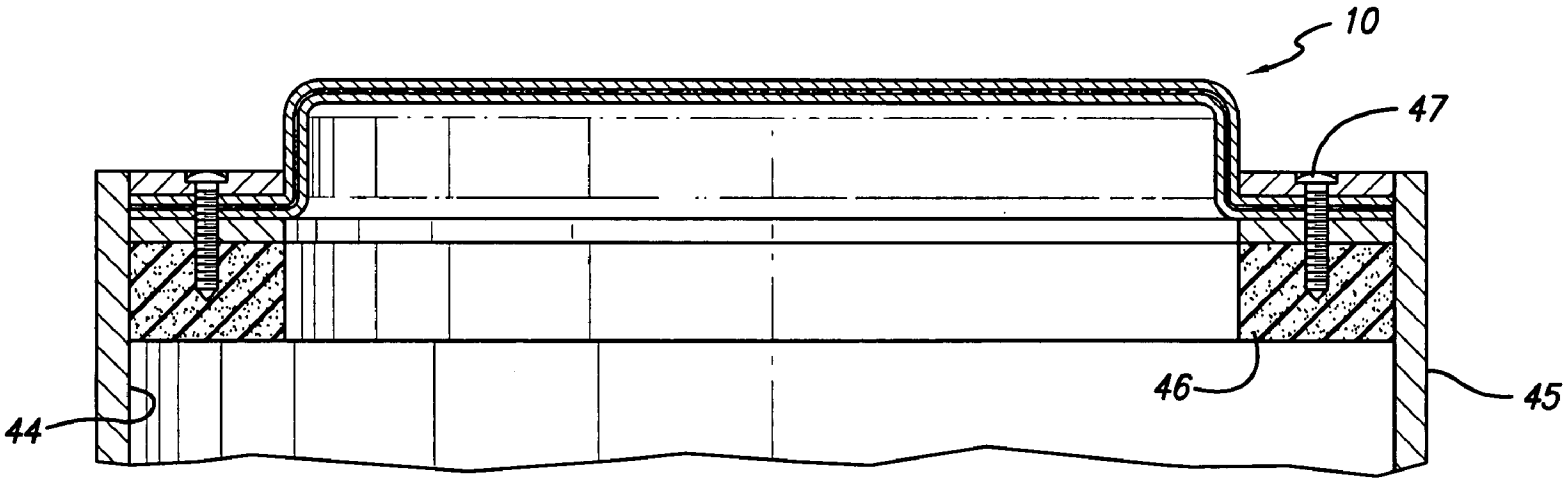
FIG. 7 is a perspective view of the improved multi-layered drumhead of the present invention.
Figure 8:
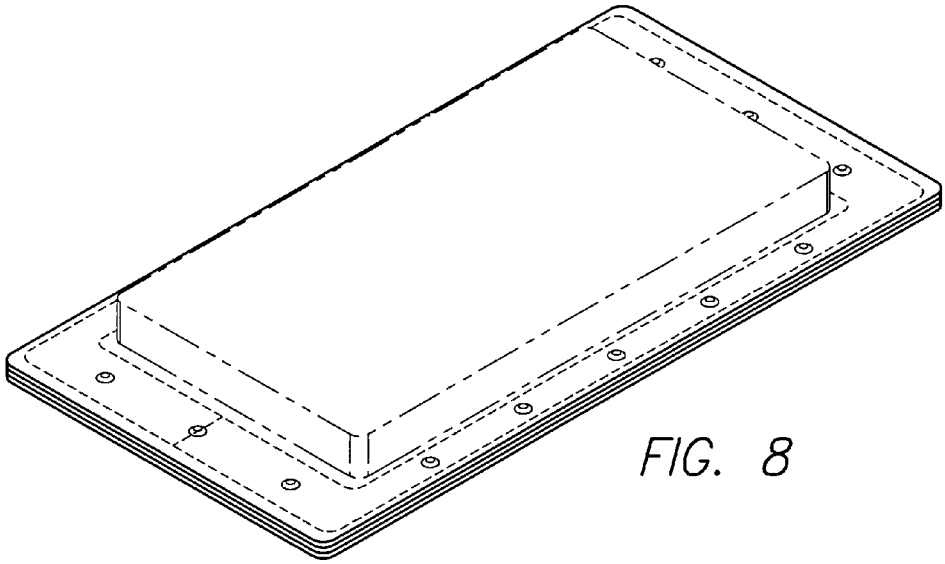
FIG. 8 is a perspective view of an alternative embodiment of the improved drumhead of the present invention.
Figure 9:
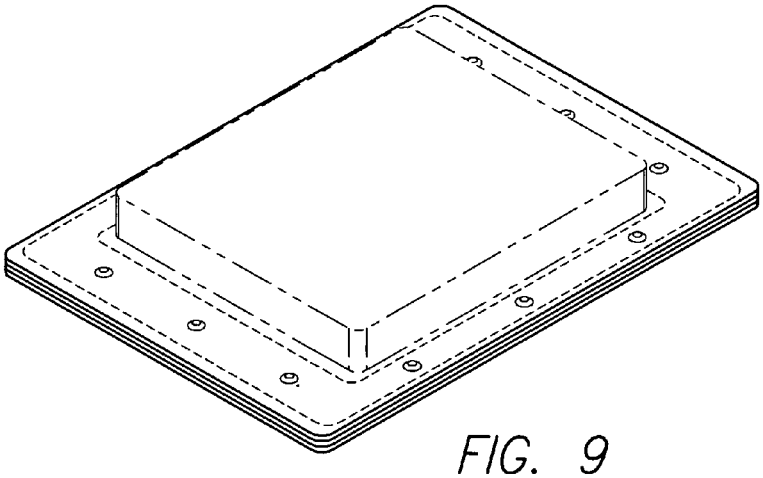
FIG. 9 is a perspective view of another alternative embodiment of the improved drumhead of the present invention.
Figure 10:
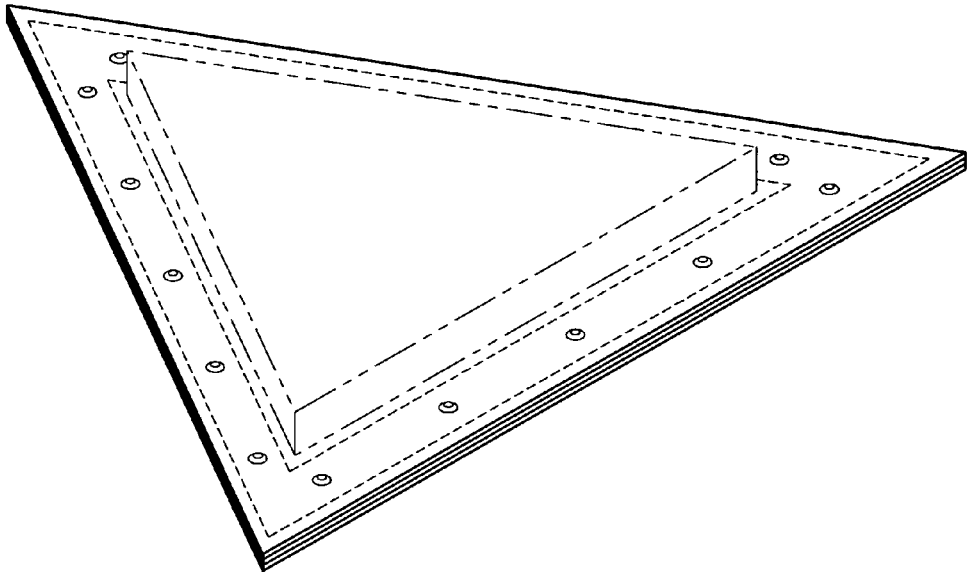
FIG. 10 is a perspective view of another alternative embodiment of the improved drumhead of the present invention.

FIG. 1 depicts a perspective view of the preferred embodiment of the present invention designated generally as 10. Drumhead 10, which is tunable, but also may be pre-tuned (pre-tensioned), is comprised of an annular hoop 12 having a generally planar upper member 14 and a generally planar lower member 16, which are parallel to and spaced apart from one another. Hoop 12 includes a circumferential inner rim 18 and a circumferential outer rim 20. A layer of film material 22, which constitutes the contact or drumming surface, extends in a flat linear manner across the area 24 defined within circumferential inner rim 18 and continues across the area 26 defined between the circumferential inner rim 18 and circumferential outer rim 20 to ensure the maximum surface area contact between the components of the annular hoop 12 and film material 22. Adhesive material 28, such as a polyamide web adhesive, or any other suitable adhesive maybe employed to bond and secure film material 22 to and between planar upper member 14 and planar lower member 16. For pre-tuned heads, adhesive material 28 also serves to maintain the appropriate tension on film material 22. Additional mechanical means may be employed to supplement and ensure the proper tensioning of film material 22. This, for example, includes a plurality of radially spaced openings 30 formed within the annular hoop 12. Bolt 31 or some other suitable device is inserted into each of these openings, and then may be secured with a nut (not shown) and tightened to add strength to the bond between annular hoop 12 and film material 22. Rivet 35 can also be used for this purpose. Appropriate stitching 33 using any suitable natural or synthetic yarn is also an option in this regard.

Planar upper member 14 and planar lower member 16 each may be comprised of one or more layers of material to ensure that annular hoop 12 is maintained at the appropriate strength and resiliency. Construction materials for this purpose include, without limitation, medium to high density fiberboard, polyester film (of varying thicknesses) and aramid/composite fibers.

Drumhead 10 is provided in a variety of sizes and dimensions, and its components may be pre-cut accordingly.

Various configurations can also be employed, including round, oval, rectangular, square, triangular and assorted other geometric shapes.

In one of its preferred embodiments (FIG. 4), drumhead 50 includes a striking surface 52 with a rim 54 and an annular shoulder 56 formed below rim 54. Peripheral section 58 of drumhead 50 is secured and bonded between components of annular hoop 60 comprised of generally planar upper member 62 and generally planar lower member 64. Drumhead 50 can be adapted to any conventional drumshell, modified, if necessary, or not, using a counterhoop and any suitable tensioning mechanism (not shown). When used with the conga drum shell 49, for example, a counterhoop 65 with a flat lower surface 66 and a rounded or curved upper surface 68 is provided and acts as a guard and a support member for the player's hands to preclude against soreness or injury to that part of the anatomy.

When it is desirable to adapt drumhead 10 to a more standard drumshell 32, conventional bolts 31 and lugs 37 can be employed in combination with openings 30 to secure the drumhead 10 to the shell 32 and tension the head accordingly. In this embodiment, it is appropriate to use a flat counter-hoop 34. Flat counter-hoop 34 may vary in its size and thickness depending on a number of factors, including the size and thickness of the drumhead 10, the size and bulk of the drumshell 32 and certain economic factors. Shell 32 can range in height from as small as 1" to several feet or more, as desired.

In another embodiment, drumhead 10 can be adapted to be mounted and secured on the inside wall 44 of a standard drumshell 45. There, with the support of a shoulder mount 46, upon which the annular hoop 12 may rest, the head is fixed using a screw 47 or some other suitable means. A counter-hoop may or may not be employed.

While the invention will be described in connection with a certain preferred embodiment, it is to be understood that it is not intended to limit the invention to that particular embodiment. Rather, it is intended to cover all alternatives, modifications and equivalents as may be included within the spirit and scope of the invention as defined by the appended.

The invention claimed is:

1. A drumhead comprising:

a frame member having a generally planar upper member and a generally planar lower member parallel to and spaced apart from said planar upper member, an inner rim and an outer rim;

a material for constituting a drumming surface extending flat across the area defined within said inner rim, said material for constituting a drumming surface having a rim portion integrally formed therewith, including a generally vertically continuous wall flowing from said drumming surface, and a shoulder member formed below said rim portion and in conjunction with said wall, which includes a base portion, wherein said wall at its base portion extends flat across the area defined between said inner rim and said outer rim to maximize the surface to surface contact between said material constituting a drumming surface and said planar upper member and said planar lower member and ensure that said material constituting a drumming surface is fixably secured; and a means to secure said material constituting a drumming surface between said planar upper member and said planar lower member of said frame member.

2. The drumhead of claim 1 wherein said annular hoop includes a means to secure said drumhead to a drumshell.

3. The drumhead of claim 2 wherein said means to secure said drumhead to a drumshell enables the tensioning of said material for constituting a drumming surface.

4. The drumhead of claim 1 wherein said planar upper member of said annular hoop comprises one or more layers of material.

5. The drumhead of claim 1 wherein said planar lower member of said annular hoop comprises one or more layers of material.

6. The drumhead of claim 2 wherein said means to secure said drumhead to a drumshell comprises a plurality of openings disposed within said annular hoop and corresponding bolt members adapted to engage said openings in a fastening relationship and connect to the drumshell to enable support for said drumhead and the tensioning of said material constituting a drumming surface.

7. The drumhead of claim 1 wherein said annular hoop measures less than ⅜" in thickness.

8. The drumhead of claim 1 wherein said means to secure said material constituting a drumming surface between said planar upper member and said planar lower member of said annular hoop comprises an adhesive compound.

9. The drumhead of claim 1 wherein said means to secure said material constituting a drumming surface between said planar upper member and said planar lower member of said annular hoop comprises a plurality of spaced openings disposed within said annular hoop and corresponding insertable rivets or combinations of nuts and bolts.

10. The drumhead of claim 8 wherein said adhesive compound is a polyamide web adhesive.

11. The drumhead of claim 1 wherein said planar upper member and said planar lower member are comprised of fiberboard.

12. The drumhead of claim 1 wherein said planar upper member and said planar lower member are comprised of a synthetic material.

13. The drumhead of claim 1 wherein said material constituting a drumming surface is comprised of polyester.

14. The drumhead of claim 1 wherein said drumhead is tunable to produce a tone of a desired pitch.

15. The drumhead of claim 1 wherein said material constituting a drumming surface is comprised of more than one layer.

16. A drumhead comprising:

a frame member having a generally horizontally oriented planar upper member and a generally horizontally oriented planar lower member parallel to and spaced apart from said horizontally oriented planar upper member, an inner rim and an outer rim;

a material for constituting a drumming surface, said material for constituting a drumming surface having a rim portion, which extends into a generally vertically continuous side wall having a bottom section, and a horizontally oriented shoulder member formed integrally with said bottom section, wherein said horizontally oriented shoulder member extends flat across the area defined between said inner rim and said outer rim; and, a means to secure said material constituting a drumming surface between said horizontally oriented planar upper member and said horizontally oriented planar lower member of said frame member.

* * * * *